US011164402B2

(12) United States Patent
Liu et al.

(10) Patent No.: US 11,164,402 B2
(45) Date of Patent: Nov. 2, 2021

(54) VEHICLE DATA STREAM DISPLAYING METHOD AND SYSTEM, AND VEHICLE DIAGNOSTIC DEVICE

(71) Applicant: SHENZHEN LAUNCH SOFTWARE CO., LTD., Guangdong (CN)

(72) Inventors: Jun Liu, Guangdong (CN); Chunwu Deng, Guangdong (CN)

(73) Assignee: SHENZHEN LAUNCH SOFTWARE CO., LTD., Guangdon (CN)

( * ) Notice: Subject to any disclaimer, the term of this patent is extended or adjusted under 35 U.S.C. 154(b) by 229 days.

(21) Appl. No.: 16/369,877

(22) Filed: Mar. 29, 2019

(65) Prior Publication Data

US 2019/0333297 A1 Oct. 31, 2019

Related U.S. Application Data

(63) Continuation-in-part of application No. PCT/CN2018/084450, filed on Apr. 25, 2018.

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01); *G07C 5/0816* (2013.01)

(58) Field of Classification Search
CPC .... G07C 5/0808; G07C 5/008; G07C 5/0816; G07C 5/0825; G07C 2205/02; G05B 23/0213; G05B 2219/24065
See application file for complete search history.

(56) References Cited

U.S. PATENT DOCUMENTS

2014/0075356 A1* 3/2014 Gray ..... G07C 5/008 715/771

FOREIGN PATENT DOCUMENTS

| | | | |
|---|---|---|---|
| CN | 102981501 | A | 3/2013 |
| CN | 106844689 | | 6/2017 |
| CN | 10697061 | A | 7/2017 |
| CN | 106993056 | A | 7/2017 |
| CN | 107103032 | A | 8/2017 |

OTHER PUBLICATIONS

Written Opinion and International Search Report of International application No. PCT/CN2018/084450 dated Jan. 23, 2019, 9 pages (Chinese).

* cited by examiner

*Primary Examiner* — Michael V Kerrigan
(74) *Attorney, Agent, or Firm* — Rankin, Hill & Clark LLP

(57) ABSTRACT

The present disclosure provides a vehicle data stream displaying method and system, and a vehicle diagnostic device. The method includes: numbering at least one vehicle data stream that is displayed out of order; sorting the vehicle data stream, and displaying the vehicle data stream according to a sorting order; selecting at least one target data stream from the vehicle data stream according to a target data stream selection instruction; paging displaying the at least one target data stream; obtaining number data of a target data stream displayed on each page, and establishing a correlation relationship between a display page number and the number data; and paging refreshing a target data stream displayed on a current page, according to the correlation relationship between the display page number and the number data if a refreshing instruction is received.

12 Claims, 3 Drawing Sheets

VEHICLE DATA STREAM DISPLAYING METHOD AND SYSTEM, AND VEHICLE DIAGNOSTIC DEVICE

This application is a continuation-in-part of Serial No. PCT/CN2018/084450 filed on Apr. 25, 2018 and its entirety is expressly incorporated herein by reference.

TECHNICAL FIELD

The present disclosure pertains to the technical field of vehicle data stream displaying, and particularly, to a vehicle data stream displaying method and system, and a vehicle diagnostic device.

BACKGROUND

A vehicle data stream is referred to as data parameters exchanged between an electronic control unit and sensors and an actuator. A data stream recorded in the electronic control unit really reflects working voltages and statuses of the sensors and the actuator, and provides a basis for vehicle fault diagnosis. The data stream can be read only by dedicated diagnosis equipment. Reading the vehicle data stream can detect the working statuses of the sensors of the vehicle, and detect a working status of the vehicle. In addition, operation data of the vehicle may be set by using the data stream. The vehicle data stream may be used as input/output data of the electronic control unit, so that a maintenance worker can know a working condition of the vehicle at any time, and diagnose a fault of the vehicle in time.

SUMMARY

Currently, there are more vehicle sensors, and there are more vehicle data streams. When a vehicle is diagnosed, sometimes, multiple data streams need to be selected from many vehicle data streams displayed by diagnosis equipment, and values of the selected multiple data streams are viewed. Because that when reading vehicle data streams, existing diagnosis equipment does not read the vehicle data streams according to data stream names, and during displaying, data stream titles are displayed out of order according to a chronological order of reading the data streams, a diagnosis worker cannot quickly view a target data stream. In addition, because that there are many data streams, and a diagnostic device needs to re-read data of many vehicle data streams during refreshing, a refreshing speed is slow.

In view of this, the present disclosure provides a vehicle data stream displaying method and system, and a vehicle diagnostic device, to resolve a problem in related art that a diagnosis worker cannot quickly view a target data stream and a vehicle data stream refreshing speed is slow.

A first aspect of the present disclosure provides a vehicle data stream displaying method, including:

numbering at least one vehicle data stream that is displayed out of order;

sorting the at least one vehicle data stream, and displaying the at least one vehicle data stream according to a sorting order;

receiving a target data stream selection instruction, and selecting at least one target data stream from the at least one vehicle data stream according to the target data stream selection instruction;

paging displaying the at least one target data stream;

obtaining number data of a target data stream displayed on each page, and establishing a correlation relationship between a display page number and the number data; and paging refreshing, if a refreshing instruction is received, a target data stream displayed on a current page, according to the correlation relationship between the display page number and the number data.

Based on the aforesaid technical solution, the step of paging refreshing, if a refreshing instruction is received, a target data stream displayed on a current page, according to the correlation relationship between the display page number and the number data includes:

reading a display page number of the current page, and obtaining a number of the target data stream displayed on the current page according to the display page number and the correlation relationship between the display page number and the number data, if the refreshing instruction is received; and requesting to read a corresponding vehicle data stream according to the number data of the target data stream displayed on the current page, and refreshing the target data stream displayed on the current page by using the read vehicle data stream.

Based on the aforesaid technical solution, after the refreshing instruction is received, the method further includes:

determining whether it is currently in a vehicle data stream recording state; and performing the step of paging refreshing a target data stream displayed on a current page according to the correlation relationship between the display page number and the number data, if it is in a non-recording state; or selecting number data of target data streams displayed on all pages, and performing page refreshing according to the number data of the target data streams displayed on all the pages, if it is in the recording state.

Based on the aforesaid technical solution, the step of paging displaying the at least one target data stream includes:

calculating a total quantity of pages according to a total quantity of obtained target data streams and a preset quantity of data streams displayed on each page;

allocating a target data stream correspondingly displayed on each page in an ascending order or in a descending order of a letter of a data stream title according to the preset quantity of the data streams displayed on each page; and paging displaying the at least one target data stream according to an allocation result.

A second aspect of the present disclosure provides a vehicle diagnostic device, including a memory, a processor, and a computer program stored in the memory and executable on the processor, where the processor is configured to execute the computer program to implement steps in a vehicle data stream displaying method, including: numbering at least one vehicle data stream that is displayed out of order; sorting the at least one vehicle data stream, and displaying the at least one vehicle data stream according to a sorting order; receiving a target data stream selection instruction, and selecting at least one target data stream from the at least one vehicle data stream according to the target data stream selection instruction; paging displaying the at least one target data stream; obtaining number data of a target data stream displayed on each page, and establishing a correlation relationship between a display page number and the number data; and paging refreshing a target data stream displayed on a current page, according to the correlation relationship between the display page number and the number data if a refreshing instruction is received.

In a first technical solution of the second aspect of the present disclosure, the processor is further configured to execute the step of paging refreshing a target data stream displayed on a current page, according to the correlation relationship between the display page number and the number data if a refreshing instruction is received by: reading a display page number of the current page if the refreshing instruction is received, and then obtaining number data of the target data stream displayed on the current page according to the display page number and the correlation relationship between the display page number and the number data; and requesting to read a corresponding vehicle data stream according to the number data of the target data stream displayed on the current page, and refreshing the target data stream displayed on the current page by using the read vehicle data stream.

Based on the second aspect of the present disclosure, in a second technical solution of the second aspect of the present disclosure, the processor is further configured to: determine whether it is currently in a vehicle data stream recording state after the refreshing instruction is received; and perform the step of paging refreshing a target data stream displayed on a current page, according to the correlation relationship between the display page number and the number data if it is in a non-recording state; or select number data of target data streams displayed on all pages, and perform page refreshing according to the number data of the target data streams displayed on all the pages if it is in the recording state.

Based on the second aspect of the present disclosure, in a third technical solution of the second aspect of the present disclosure, the processor is further configured to perform the step of paging displaying the at least one target data stream by: calculating a total quantity of pages according to a total quantity of obtained target data streams and a preset quantity of data streams displayed on each page; allocating a target data stream correspondingly displayed on each page in an ascending order or a descending order of a letter of a data stream title according to the preset quantity of the data streams displayed on each page; and paging displaying the at least one target data stream according to an allocation result.

A third aspect of the present disclosure provides a computer readable storage medium, where the computer readable storage medium stores a computer program, when the computer program is executed by a processor, the processor is configured to implement steps in a vehicle data stream displaying method, including: numbering at least one vehicle data stream that is displayed out of order; sorting the at least one vehicle data stream, and displaying the at least one vehicle data stream according to a sorting order; receiving a target data stream selection instruction, and selecting at least one target data stream from the at least one vehicle data stream according to the target data stream selection instruction; paging displaying the at least one target data stream; obtaining number data of a target data stream displayed on each page, and establishing a correlation relationship between a display page number and the number data; and paging refreshing a target data stream displayed on a current page, according to the correlation relationship between the display page number and the number data if a refreshing instruction is received.

Based on the third aspect of the present disclosure, in a first technical solution of the third aspect of the present disclosure, the processor is further configured to perform the step of paging refreshing a target data stream displayed on a current page, according to the correlation relationship between the display page number and the number data if a refreshing instruction is received by: reading a display page number of the current page if the refreshing instruction is received, and then obtaining number data of the target data stream displayed on the current page according to the display page number and the correlation relationship between the display page number and the number data; and requesting to read a corresponding vehicle data stream according to the number data of the target data stream displayed on the current page, and refreshing the target data stream displayed on the current page by using the read vehicle data stream.

Based on the third aspect of the present disclosure, in a second technical solution of the third aspect of the present disclosure, the processor is further configured to: determine whether it is currently in a vehicle data stream recording state after the refreshing instruction is received; and perform the step of paging refreshing a target data stream displayed on a current page, according to the correlation relationship between the display page number and the number data if it is in a non-recording state; or select number data of target data streams displayed on all pages, and perform page refreshing according to the number data of the target data streams displayed on all the pages if it is in the recording state.

Based on the third aspect of the present disclosure, in a third technical solution of the third aspect of the present disclosure, the processor is further configured to perform the step of paging displaying the at least one target data stream by: calculating a total quantity of pages according to a total quantity of obtained target data streams and a preset quantity of data streams displayed on each page; allocating, a target data stream correspondingly displayed on each page in an ascending order or a descending order of a letter of a data stream title according to the preset quantity of the data streams displayed on each page; and paging displaying the at least one target data stream according to an allocation result.

Advantageous Effects

In the present disclosure, the at least one vehicle data stream displayed out of order is sorted and displayed, so that the diagnosis worker can conveniently and quickly find a target data stream from many vehicle data streams. The target data stream is paging-refreshed, so that a data stream refreshing speed when the target data stream is viewed can be increased.

BRIEF DESCRIPTION OF DRAWINGS

In order to describe the technical solutions in the embodiments of the present disclosure more clearly, the accompanying drawings required for describing the embodiments or the prior art are briefly described in the following.

DESCRIPTION OF EMBODIMENTS

In the following description, for description rather than limitation, specific details such as a particular system structure and a technology are provided for thorough understanding of the present disclosure. In other cases, detailed descriptions of a commonly-known system, vehicle diagnostic device, circuit, and method are omitted, so that the present disclosure is described without being obscured by unnecessary details.

To describe the technical solutions of the present disclosure, descriptions are given with reference to specific embodiments.

Figure 1:
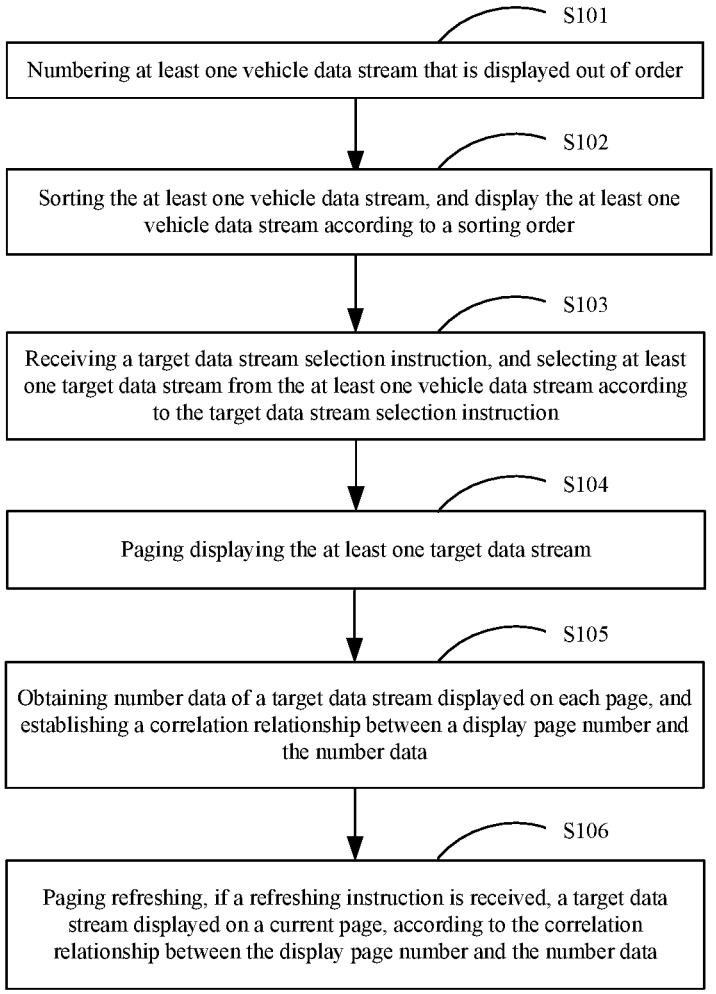
FIG. 1 is a schematic flow diagram of implementing a vehicle data stream displaying method according to an embodiment of the present disclosure.

FIG. 1 is a schematic flow diagram of implementing a vehicle data stream displaying method according to an embodiment of the present disclosure. The method is applied to a vehicle diagnostic device. As shown in FIG. 1, an implementation process of the method is described in detail as follows.

Step 101, numbering at least one vehicle data stream that is displayed out of order.

In this embodiment, the at least one vehicle data stream displayed out of order is referred to as at least one vehicle data stream obtained after the vehicle diagnostic device arranges and displays, according to a chronological vehicle data stream reading order or randomly, a vehicle data stream that is output by a vehicle electronic control unit and that is read within a preset time period.

In this embodiment, after the at least one vehicle data stream displayed out of order by the vehicle diagnostic device is obtained, the at least one vehicle data stream may be numbered with a figure according to a display location of the vehicle data stream. For example, the at least one vehicle data stream is sequentially numbered 1, 2, 3, . . . , n according to the display location of the at least one vehicle data stream, where n is a positive integer equal to a quantity of the vehicle data streams.

Step 102, sorting the at least one vehicle data stream, and displaying the at least one vehicle data stream according to a sorting order.

In this embodiment, the at least one vehicle data stream is particularly sorted in an ascending order or in a descending order of a letter of a data stream title. The data stream title is a vehicle data stream name. The vehicle data stream name is in a Chinese form or an English form. When the vehicle data stream name is in the Chinese form, the at least one vehicle data stream is sorted in an ascending order or in a descending order of a capital of Pinyin of the vehicle data stream. When the vehicle data stream name is in the English form, the at least one vehicle data stream is sorted in an ascending order or a descending order of a capital of an English name of the vehicle data stream.

In this embodiment, because that the vehicle diagnostic device displays the at least one vehicle data stream in the ascending order or in the descending order of the letter of the data stream title, the read vehicle data stream is arranged in order instead of being arranged out of order, so that a user can conveniently and quickly find a target data stream from many vehicle data streams.

Step 103, receiving a target data stream selection instruction, and selecting at least one target data stream from the at least one vehicle data stream according to the target data stream selection instruction.

In this embodiment, the user may select, from the at least one vehicle data stream arranged in order and according to a name of the target data stream, the at least one target data stream needing to be viewed.

Preferably, a display interface of the vehicle diagnostic device is a touch display. The vehicle diagnostic device receives, by using the touch display, the target data stream selection instruction as input by the user. When a user touch operation is detected at a location of displaying a vehicle data stream on the touch display, and duration of the touch operation reaches a preset time threshold, it indicates that the vehicle data stream is selected as a target data stream. The user may select multiple data streams from many vehicle data streams as target data streams.

Step 104, paging displaying the at least one target data stream.

In this embodiment, the at least one target data stream is paging-displayed according to a total quantity of obtained target data streams and a preset quantity of data streams displayed on each page. Step 104 specifically includes:

calculating a total quantity of pages according to the total quantity of the obtained target data streams and the preset quantity of the data streams displayed on each page;

allocating a target data stream correspondingly displayed on each page in the ascending order or in the descending order of a letter of a data stream title according to the preset quantity of the data streams displayed on each page; and paging displaying the at least one target data stream according to an allocation result.

Preferably, in this embodiment, the target data stream corresponding to each page is sorted and displayed in ascending order or descending order of a data stream title.

The preset quantity of the data streams displayed on each page may be a largest quantity of data streams that can be displayed on each page, and may be set or modified by the user according to a browsing habit of the user. The step of calculating a total quantity of pages according to the total quantity of the obtained target data streams and the preset quantity of the data streams displayed on each page specifically includes:

dividing the total quantity of the target data streams by the preset quantity of the data streams displayed on each page; and using the integer as the total quantity of the pages if a result is an integer; or adding one to an integral part of the result to obtain the total quantity of the pages if a result includes a decimal. For example, if the preset quantity of the data streams displayed on each page is 10, and the quantity of the target data streams is 95, the total quantity of the pages is 10, where only five target data streams are displayed on the last page, and 10 data streams are displayed on each of the other pages.

In this embodiment, when the at least one target data stream is paging-displayed, the target data stream displayed on each page is displayed in the ascending order or in the descending order of a letter of a data stream title, so that the user can conveniently view the data stream, and the user experience is further improved.

Step 105, obtaining number data of a target data stream displayed on each page, and establishing a correlation relationship between a display page number and the number data.

In this embodiment, after the at least one target data stream is paging-displayed, the number data of the target data stream displayed on each page needs to be obtained, the correlation relationship is established between the display page number and the number data, and the correlation relationship between the display page number and the number data is stored for subsequent invoking.

Step 106, refreshing a target data stream paging-displayed on a current page according to the correlation relationship between the display page number and the number data, if a refreshing instruction is received.

In this embodiment, step 106 specifically includes:

reading a display page number of the current page, and obtaining, according to the display page number and the correlation relationship between the display page number and the number data, a number of the target data stream displayed on the current page if the refreshing instruction is received; and requesting to read a corresponding vehicle data stream according to the number data of the target data stream displayed on the current page, and refreshing, by using the read vehicle data stream, the target data stream displayed on the current page.

Similarly, after a page turning instruction is received, number data of a displayed corresponding target data stream is selected according to a page number obtained after page turning, and then, the corresponding target data stream is read according to the number data.

In this embodiment, when various types of vehicle data streams are numbered, the vehicle diagnostic device records a correspondence between a type of a vehicle data stream and number data. The step of requesting to read a corresponding vehicle data stream according to the number data of the target data stream displayed on the current page specifically includes: determining, according to the number data of the target data stream displayed on the current page, a type of a vehicle data stream needing to be re-collected; and then, collecting the corresponding vehicle data stream according to the type of the vehicle data stream needing to be re-collected.

In this embodiment, when the refreshing instruction is received on the current page, only the target data stream displayed on the current page is re-obtained, and there is no need to re-obtain all target data streams Therefore, a time required for data obtaining can be reduced, and a refreshing speed can be increased.

Preferably, in this embodiment, after the refreshing instruction is received, the method further includes:

determining whether it is currently in a vehicle data stream recording state; and performing the step of refreshing a target data stream paging-displayed on a current page, according to the correlation relationship between the display page number and the number data if it is in a non-recording state; or selecting number data of target data streams displayed on all pages, and performing page refreshing according to the number data of the target data streams displayed on all the pages if it is in the recording state.

Because that the vehicle diagnostic device in the recording state needs to keep all target data streams in a data stream recording file, if receiving the refreshing instruction, the vehicle diagnostic device in the recording state needs to refresh all the target data streams.

As can be learned from the above, in the vehicle data stream displaying method provided in this embodiment, the at least one vehicle data stream displayed out of order is sorted and displayed, so that a diagnosis worker can conveniently and quickly find a target data stream from many vehicle data streams. The target data stream is paging-refreshed, so that a data stream refreshing speed when the target data stream is viewed can be increased.

Figure 2:
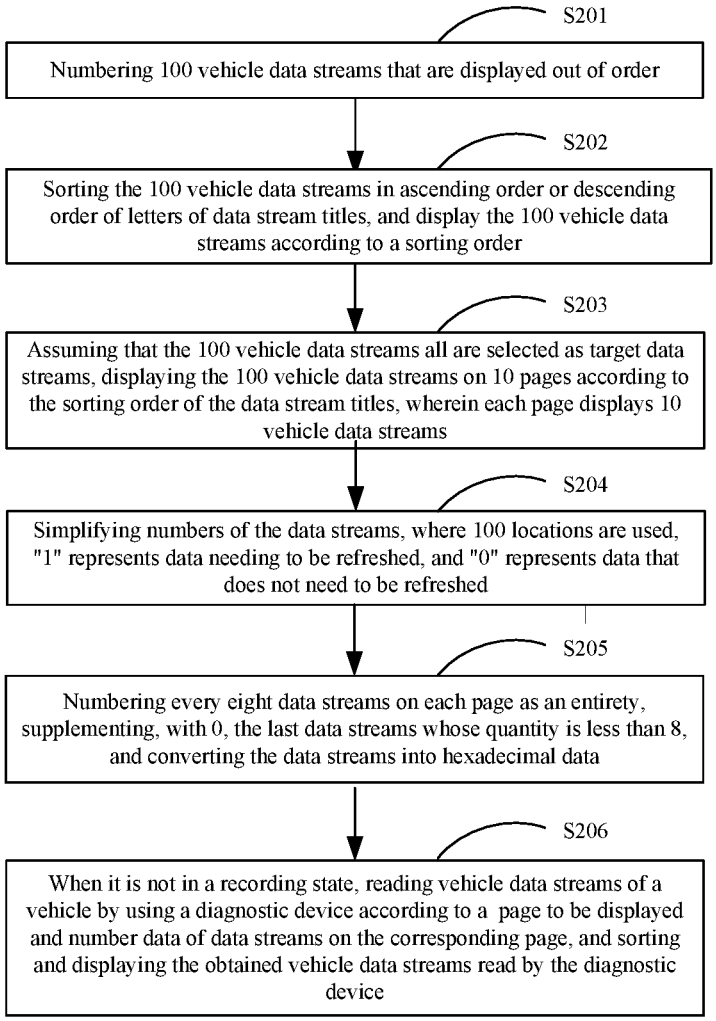
FIG. 2 is a schematic flow diagram of implementing a vehicle data stream displaying method according to a specific implementation example of the present disclosure.

FIG. 2 is a schematic flow diagram of implementing a vehicle data stream displaying method according to a specific implementation example of the present disclosure. The method is applied to a vehicle diagnostic device. As shown in FIG. 2, a specific implementation procedure of the method is described in detail as follows.

Step 201, numbering 100 vehicle data streams that are displayed out of order, and numbering the 100 vehicle data streams from 0 to 99 according to locations of the 100 vehicle data streams.

Step 202, sorting the 100 vehicle data streams in an ascending order or in a descending order of letters of data stream titles, and displaying the 100 vehicle data streams according to a sorting order. It is assumed that the order of the vehicle data streams after the vehicle data streams are arranged in the ascending order or in the descending order of the letters of the data stream titles is: the first vehicle data stream, the 11th vehicle data stream, the 21st vehicle data stream, the 31st vehicle data stream, . . . , the 91st vehicle data stream, the second vehicle data stream, the 12th vehicle data stream, . . . , the 92nd vehicle data stream, the third vehicle data stream, the 13th vehicle data stream, . . . , the 93th vehicle data stream, . . . , the 10th vehicle data stream, the 20th vehicle data stream, . . . , the 100th vehicle data stream.

Step 203, assuming that the 100 vehicle data streams all are selected as target data streams, displaying the 100 vehicle data streams on 10 pages according to the sorting order of the data stream titles, wherein each page displays 10 vehicle data streams, and location numbers of vehicle data streams displayed on the first page are: 0, 10, 20, 30, . . . , 90;

location numbers of vehicle data streams displayed on the second page are: 1, 11, 21, 31, . . . , 91;

location numbers of vehicle data streams displayed on the 10th page are: 9, 19, 29, 39, . . . , 99.

Step 204, simplifying numbers of the data streams, wherein 100 locations are used, "1" represents data needing to be refreshed, and "0" represents data that does not need to be refreshed. That is:

data needing to be refreshed on the first page is (values of data streams whose location numbers are 0, 10, 20, 30, . . . , 90 are 1, and values of the other bits are 0):
1000000000100000000010000000001000000000001000
00000010000000001000000
0010000000001000000000100000000;

data needing to be refreshed on the second page is (values of data streams whose location numbers are 1, 11, 21, 31, . . . , 91 are 1, and values of the other bits are 0):
0100000000010000000001000000000100000000001
00000000010000000001000000
0001000000000100000000010000000;

data needing to be refreshed on the tenth page is (values of data streams whose location numbers are 9, 19, 29, 39, . . . , 99 are 1, and values of the other bits are 0):
0000000000100000000010000000001000000000100
00000001000000000100000000
0100000000010000000001000000000001.

Step 205, numbering every eight data streams on each page as an entirety, supplement, with 0, the last data streams whose quantity is less than 8, and converting the data streams into hexadecimal data. For example:

10000000 00100000 00001000 00000010 00000000 10000000 00100000 00001000 00000010 00000000 10000000 00100000 00000000 (the last four zeros are supplemented data) on the first page is converted into 0x80, 0x20, 0x08, 0x02, 0x00, 0x80, 0x20, 0x08, 0x02, 0x00, 0x80, 0x20, 0x00;

01000000 00010000 00000100 00000001 00000000 01000000 00010000 00000100 00000001 00000000 01000000 00010000 00000000 (the last four zeros are supplemented data) on the second page is converted into 0x40, 0x10, 0x04, 0x01, 0x00, 0x40, 0x10, 0x04, 0x01, 0x00, 0x40, 0x10, 0x00;

00000000 01000000 00010000 00000100 00000001 00000000 01000000 00010000 00000100 00000001 00000000 01000000 00010000 (the last four zeros are supplemented data) on the tenth page is converted into 0x00, 0x40, 0x10, 0x04, 0x01, 0x00, 0x40, 0x10, 0x04, 0x01, 0x00, 0x40, 0x10.

Step 206, when it is not in a recording state, reading data of vehicle data streams of a vehicle by using a diagnostic device according to a page to be displayed and number data of data streams on the corresponding page, and sorting and displaying the obtained vehicle data streams read by the diagnostic device. During page turning, a page number is changed, and number data of a data stream is changed. The diagnostic device requests, according to the number data of the data stream, a data stream needing to be requested on the corresponding page.

As can be learned from the above, in the vehicle data stream displaying method provided in this embodiment, the vehicle data streams displayed out of order are sorted and displayed, so that a diagnosis worker can conveniently and quickly find a target data stream from many vehicle data streams. The target data stream is paging-refreshed, so that a data stream refreshing speed when the target data stream is viewed can be increased.

Figure 3:
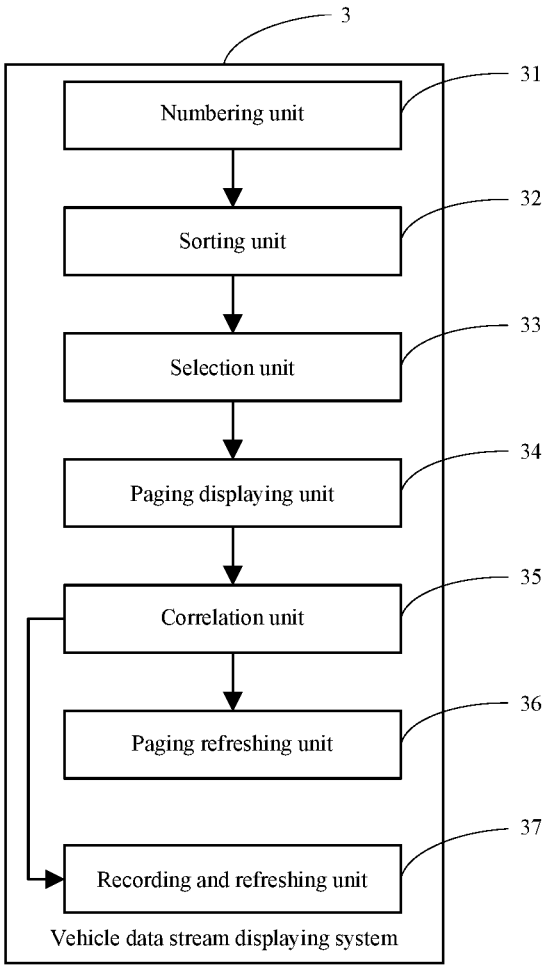
FIG. 3 is a schematic structural diagram of a vehicle data stream displaying system according to an embodiment of the present disclosure.

FIG. 3 is a schematic structural diagram of a vehicle data stream displaying system according to an embodiment of the present disclosure. The system is applied to a vehicle diagnostic device. For the convenience of description, only a part related to this embodiment is shown.

As shown in FIG. 3, a vehicle data stream displaying system 3 provided in this embodiment includes:

a numbering unit 31 configured to number at least one vehicle data stream that is displayed out of order;

a sorting unit 32 configured to: sort the at least one vehicle data stream, and display the at least one vehicle data stream according to a sorting order;

a selection unit 33 configured to: receive a target data stream selection instruction, and select at least one target data stream from the at least one vehicle data stream according to the target data stream selection instruction;

a paging displaying unit 34 configured to paging display the at least one target data stream;

a correlation unit 35, configured to: obtain number data of a target data stream displayed on each page, and establish a correlation relationship between a display page number and the number data; and a paging refreshing unit 36, configured to: refresh a target data stream paging-displayed on a current page, according to the correlation relationship between the display page number and the number data if a refreshing instruction is received.

In one embodiment, the paging refreshing unit 36 is particularly configured to:

read a display page number of the current page, and obtain a number of the target data stream displayed on the current page according to the display page number and the correlation relationship between the display page number and the number data, if the refreshing instruction is received; and request to read a corresponding vehicle data stream according to the number data of the target data stream displayed on the current page, and refresh the target data stream displayed on the current page by using the read vehicle data stream.

In one embodiment, the vehicle data stream displaying system 3 further includes a recording and refreshing unit 37 configured to:

determine whether it is currently in a vehicle data stream recording state; and perform the step of paging-refreshing a target data stream displayed on a current page, according to the correlation relationship between the display page number and the number data if it is in a non-recording state; or select number data of target data streams displayed on all pages, and perform page refreshing according to the number data of the target data streams displayed on all the pages if it is in the recording state.

In one embodiment, the paging displaying unit 34 is particularly configured to:

calculate a total quantity of pages according to a total quantity of obtained target data streams and a preset quantity of data streams displayed on each page;

allocate, in an ascending order or in a descending order of a letter of a data stream title according to the preset quantity of the data streams displayed on each page, a target data stream correspondingly displayed on each page; and paging display the at least one target data stream according to an allocation result.

It should be noted that because that the units of the system provided in this embodiment of the present disclosure are based on a same concept as the method embodiment of the present disclosure, technical effects thereof are the same as those of the method embodiment of the present disclosure. For specific content, refer to the descriptions in the method embodiment of the present disclosure, and details are not described herein again.

As can be learned from the above, in the vehicle data stream displaying system provided in this embodiment, the vehicle data stream displayed out of order is sorted and displayed, so that a diagnosis worker can conveniently and quickly find a target data stream from many vehicle data streams. The target data stream is paging refreshed, so that a data stream refreshing speed when the target data stream is viewed can be increased.

It should be understood that sequence numbers of the steps in this embodiment do not represent an execution sequence. The execution sequence of the processes should be determined according to functions and internal logic. The sequence numbers should not constitute any limitation to an implementation process of this embodiment of the present disclosure.

Figure 4:
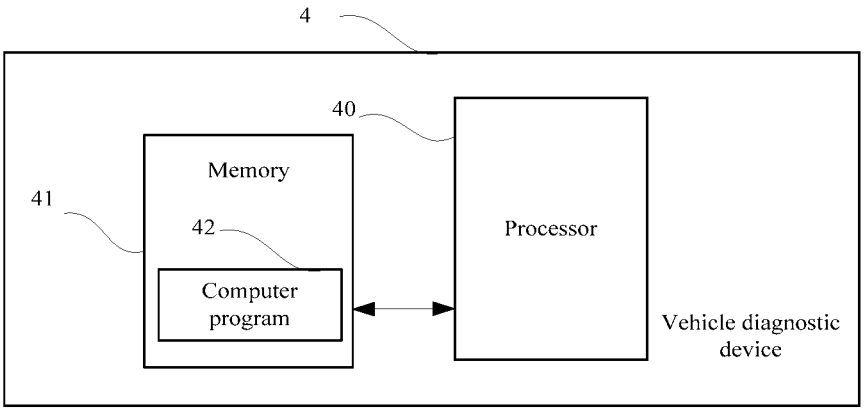
FIG. 4 is a schematic structural diagram of a vehicle diagnostic device according to an embodiment of the present disclosure.

FIG. 4 is a schematic structural diagram of a vehicle diagnostic device according to an embodiment of the present disclosure. As shown in FIG. 4, a vehicle diagnostic device 4 in this embodiment includes a processor 40, a memory 41, and a computer program 42 stored in the memory 41 and executable on the processor 40. When the processor 40 executes the computer program 42, the processor 40 implements functions of the units in the vehicle diagnostic device embodiment, for example, functions of the module 31 to the module 36 shown in FIG. 3. Alternatively, when the processor 40 executes the computer program 42, the processor 40 implements the steps in the method embodiment, for example, step 101 to step 104 shown in FIG. 1.

For example, when the processor 40 executes the computer program 42, the processor 40 implements the following steps of:

numbering at least one vehicle data stream that is displayed out of order;

sorting the at least one vehicle data stream, and displaying the at least one vehicle data stream according to a sorting order;

receiving a target data stream selection instruction, and selecting at least one target data stream from the at least one vehicle data stream according to the target data stream selection instruction;

paging displaying the at least one target data stream;

obtaining number data of a target data stream displayed on each page, and establishing a correlation relationship between a display page number and the number data; and refreshing a target data stream paging-displayed on a current page according to the correlation relationship between the display page number and the number data, if a refreshing instruction is received.

For example, when the processor 40 executes the computer program 42, the processor 40 implements the following steps of:

reading a display page number of the current page, and obtaining a number of the target data stream displayed on the current page according to the display page number and the correlation relationship between the display page number and the number data, if the refreshing instruction is received; and requesting to read a corresponding vehicle data stream according to the number data of the target data stream displayed on the current page, and refreshing the target data stream displayed on the current page by using the read vehicle data stream.

For example, when the processor 40 executes the computer program 42, the processor 40 implements the following steps of:

determining whether it is currently in a vehicle data stream recording state; and performing the step of refreshing a target data stream paging-displayed on a current page, according to the correlation relationship between the display page number and the number data if it is in a non-recording state; or selecting number data of target data streams displayed on all pages, and performing page refreshing according to the number data of the target data streams displayed on all the pages if it is in the recording state.

For example, when the processor 40 executes the computer program 42, the processor 40 implements the following steps of:

calculating a total quantity of pages according to a total quantity of obtained target data streams and a preset quantity of data streams displayed on each page;

allocating a target data stream correspondingly displayed on each page in an ascending order or in a descending order of a letter of a data stream title according to the preset quantity of data streams displayed on each page; and paging displaying the at least one target data stream according to an allocation result.

The vehicle diagnostic device 4 may include but is not limited to the processor 40 and the memory 41. The ordinary skilled one in the art may understand that FIG. 4 shows only an example of the vehicle diagnostic device, but does not limit the vehicle diagnostic device 4. The vehicle diagnostic device 4 may include more or fewer components than those shown in the figure, or some components may be combined, or the vehicle diagnostic device 4 may include different components. For example, the vehicle diagnostic device 4 may further include an input/output device, a network access device, a bus, and the like.

The processor 40 may be a central processing unit (central processing unit, CPU), or the processor may be another general purpose processor, a digital signal processor (digital signal processor, DSP), an application specific integrated circuit (application specific integrated circuit, ASIC), a field-programmable gate array (field-programmable gate array, FPGA) or another programmable logic device, a discrete gate or transistor logic device, a discrete hardware component, or the like. The general purpose processor may be a microprocessor or the processor may be any normal processor, or the like.

The memory 41 may be an internal storage unit of the vehicle diagnostic device, for example, a hard disk or a memory of the vehicle diagnostic device. The memory 41 may alternatively be an external storage device of the vehicle diagnostic device, for example, a plug-connected hard disk, a smart media card (Smart Media Card, SMC), a secure digital (Secure Digital, SD) card, or a flash card (Flash Card) disposed on the vehicle diagnostic device. Further, the memory 41 may alternatively include both the internal storage unit and the external storage device of the vehicle diagnostic device. The memory 41 is configured to store the computer program and another program and data needed by the terminal. The memory 41 may be further configured to temporarily store data that is output or that is to be output.

The ordinary skilled one in the art may be aware of that, for the convenience and brevity of descriptions, only divisions of the foregoing function units are used as an example for description. In an actual application, the functions may be allocated to different function units or modules for completion according to needs. In other words, an internal structure of the vehicle diagnostic device is divided into different function units or modules, to complete all or some functions described above. The function units or modules in the embodiments may be integrated into one processing unit, or the units may exist physically and independently, or at least two units are integrated into one unit. The integrated unit may be implemented in a form of hardware, or in a form of a software function unit. In addition, specific names of the function units or modules are merely used for distinguishing, but are not used to limit the protection scope of the present disclosure. For specific working processes of the units or modules in the system, refer to the corresponding processes in the method embodiment described above, and details are not described herein again.

In the foregoing embodiments, descriptions of the embodiments have emphases, and for a part not described or recorded in an embodiment, reference can be made to related descriptions of another embodiment.

In the embodiments provided in the present disclosure, it should be understood that the disclosed vehicle diagnosis system, device, and method may be implemented in other manners. In addition, the function units in the embodiments of the present disclosure may be integrated into one processing unit, or each of the units may exist alone physically, or two or more units are integrated into one unit. The integrated unit may be implemented in a form of hardware, or may be implemented in a form of a software function unit.

When the integrated unit is implemented in the form of a software function unit and sold or used as an independent product, the integrated unit may be stored in a computer readable storage medium. Based on such understanding, all or some procedures in the method embodiment of the present disclosure may be completed by a computer program instructing related hardware. In one embodiment, the present disclosure provides a computer readable storage medium, the computer program may be stored in the computer readable storage medium, when the computer program is executed by a processor, the processor is configured to implement steps in a vehicle data stream displaying method, including: numbering at least one vehicle data stream that is displayed out of order; sorting the at least one vehicle data stream, and displaying the at least one vehicle data stream according to a sorting order; receiving a target data stream selection instruction, and selecting at least one target data stream from the at least one vehicle data stream according to the target data stream selection instruction; paging displaying the at least one target data stream; obtaining number data of a target data stream displayed on each page, and establishing a correlation relationship between a display page number and the number data; and paging refreshing a target data stream displayed on a current page, according to the correlation relationship between the display page number and the number data if a refreshing instruction is received.

In one embodiment, the processor is further configured to perform the step of paging refreshing a target data stream displayed on a current page, according to the correlation relationship between the display page number and the number data if a refreshing instruction is received by: reading a display page number of the current page if the refreshing instruction is received, and then obtaining number data of the target data stream displayed on the current page according to the display page number and the correlation relationship between the display page number and the number data; and requesting to read a corresponding vehicle data stream according to the number data of the target data stream displayed on the current page, and refreshing the target data stream displayed on the current page by using the read vehicle data stream.

In one embodiment, the processor is further configured to: determine whether it is currently in a vehicle data stream recording state after the refreshing instruction is received; and perform the step of paging refreshing a target data stream displayed on a current page, according to the correlation relationship between the display page number and the number data if it is in a non-recording state; or select number data of target data streams displayed on all pages, and perform page refreshing according to the number data of the target data streams displayed on all the pages if it is in the recording state.

In one embodiment, the processor is further configured to perform the step of paging displaying the at least one target data stream by: calculating a total quantity of pages according to a total quantity of obtained target data streams and a preset quantity of data streams displayed on each page; allocating, in an ascending order or a descending order of a letter of a data stream title according to the preset quantity of the data streams displayed on each page, a target data stream correspondingly displayed on each page; and paging displaying the at least one target data stream according to an allocation result.

The computer program includes computer program code. The computer program code may be in a form of source code, a form of object code, a form of an executable file or some intermediate forms, or the like. The computer readable medium may include any entity or vehicle diagnostic device, recording medium, USB flash drive, movable hard disk, magnetic disk, optical disc, computer memory, read-only memory (Read-Only Memory, ROM), random access memory (Random Access Memory, RAM), electrical carrier signal, telecommunications signal, software distribution medium, and the like that can carry the computer program code. It should be noted that content included in the computer readable medium may be added or reduced appropriately according to requirements of legislation and patent practice within the jurisdiction. For example, within some jurisdictions, the computer readable medium does not include an electrical carrier signal or a telecommunications signal according to the legislation and the patent practice.

The foregoing embodiments are merely used for describing the technical solutions of the present disclosure, rather than limiting the present disclosure. Although the present disclosure is described in detail with reference to the foregoing embodiments, the ordinary skilled one in the art should understand that they may still make modifications to the technical solutions described in the foregoing embodiments or make equivalent replacements to some technical features thereof, and these modifications or replacements do not cause the essence of the corresponding technical solutions to depart from the spirit and the scope of the technical solutions of the embodiments of the present disclosure, and should be included within the protection scope of the present disclosure.

What is claimed is:

1. A vehicle data stream displaying method performed on a vehicle diagnostic device, comprising:

numbering at least one vehicle data stream that is displayed out of order on a display of the vehicle diagnostic device;

sorting the at least one vehicle data stream, and displaying the at least one vehicle data stream on the display of the vehicle diagnostic device according to a sorting order;

receiving a target data stream selection instruction through the display of the vehicle diagnostic device, and determining at least one target data stream from the at least one vehicle data stream by the vehicle diagnostic device according to the target data stream selection instruction;

paging displaying the at least one target data stream on one of a plurality of pages of the display of the vehicle diagnostic device;

obtaining number data of the target data stream displayed on each page of the plurality of pages, and establishing a correlation relationship between a displayed page number and the number data by the vehicle diagnostic device; and paging refreshing the target data stream displayed on a current page by the vehicle diagnostic device according to the correlation relationship between the displayed page number and the number data if a refreshing instruction is received;

wherein the step of paging refreshing the target data stream displayed on a current page by the vehicle diagnostic device according to the correlation relationship between the display page number and the number data if a refreshing instruction is received further comprises:

reading, if the refreshing instruction is received, a display page number of the current page, and then obtaining number data of the target data stream displayed on the current page according to the displayed page number and the correlation relationship between the display page number and the number data by the vehicle diagnostic device; and requesting to read a corresponding vehicle data stream according to the number data of the target data stream displayed on the current page, and refreshing the target data stream displayed on the current page by using the corresponding read vehicle data stream by the vehicle diagnostic device.

2. The vehicle data stream displaying method according to claim 1, wherein after the refreshing instruction is received, the method further comprises:

determining whether the vehicle diagnostic device is currently in a vehicle data stream recording state by the vehicle diagnostic device; and performing the step of paging refreshing the target data stream displayed on the current page according to the correlation relationship between the display page number and the number data by the vehicle diagnostic device if the vehicle diagnostic device is in a non-recording state; or selecting number data of target data streams displayed on all pages, and performing page refreshing according to the number data of the target data streams displayed on all the pages by the vehicle diagnostic device if the vehicle diagnostic device is in the recording state.

3. The vehicle data stream displaying method according to claim 1, wherein the step of paging displaying the at least one target data stream on one of a plurality of pages of the display of the vehicle diagnostic device further comprises:

calculating a total quantity of pages according to a total quantity of obtained target data streams and a preset quantity of data streams displayed on each page by the vehicle diagnostic device;

allocating, in an ascending order or a descending order of a letter of a data stream title according to the preset quantity of the data streams displayed on each page, the target data stream correspondingly displayed on each page by the vehicle diagnostic device; and paging displaying the at least one target data stream by the vehicle diagnostic device according to an allocation result.

4. The vehicle data stream displaying method according to claim 1, further comprising:

recording a correspondence between a type of vehicle data stream and the number data by the vehicle diagnostic device when various types of vehicle data streams are numbered; and the step of requesting to read corresponding vehicle data stream by the vehicle diagnostic device according to the number data of the target data stream displayed on the current page further comprises:

determining, according to the number data of the target data stream displayed on the current page, a type of vehicle data stream needing to be re-collected by the vehicle diagnostic device; and collecting the corresponding vehicle data stream by the vehicle diagnostic device according to the type of the vehicle data need to be re-collected.

5. The vehicle data stream displaying method according to claim 1, further comprising:

selecting, after a page turning instruction is received, number data of a displayed target data stream by the vehicle diagnostic device according to a page number obtained after page turning; and reading the corresponding target data stream by the vehicle diagnostic device according to the selected number data.

6. A vehicle diagnostic device, comprising a non-transitory memory, a processor, and a computer program stored in the memory and executable on the processor, wherein the processor is configured to execute the computer program to implement steps in a vehicle data stream displaying method, comprising: numbering at least one vehicle data stream that is displayed out of order on a display of the vehicle diagnostic device; sorting the at least one vehicle data stream, and displaying the at least one vehicle data stream on the display of the vehicle diagnostic device according to a sorting order; receiving a target data stream selection instruction through the display of the vehicle diagnostic device, and determining at least one target data stream from the at least one vehicle data stream according to the target data stream selection instruction; paging displaying the at least one target data stream; obtaining number data of the target data stream displayed on each page, and establishing a correlation relationship between a displayed page number and the number data; reading, if a refreshing instruction is received, a display page number of the current page, and then obtaining number data of the target data stream displayed on the current page according to the display page number and the correlation relationship between the display page number and the number data; and requesting to read a corresponding vehicle data stream according to the number data of the target data stream displayed on the current page, and refreshing the target data stream displayed on the current page by using the corresponding read vehicle data stream.

7. The vehicle diagnostic device according to claim 6, wherein the processor is further configured to: determine whether the vehicle diagnostic device is currently in a vehicle data stream recording state after the refreshing instruction is received; and perform the step of paging refreshing the target data stream displayed on the current page, according to the correlation relationship between the display page number and the number data if the vehicle diagnostic device is in a non-recording state; or select number data of target data streams displayed on all pages, and perform page refreshing according to the number data of the target data streams displayed on all the pages if the vehicle diagnostic device is in the recording state.

8. The vehicle diagnostic device according to claim 6, wherein the processor is further configured to perform the step of paging displaying the at least one target data stream by: calculating a total quantity of pages according to a total quantity of obtained target data streams and a preset quantity of data streams displayed on each page; allocating a target data stream correspondingly displayed on each page in an ascending order or a descending order of a letter of a data stream title according to the preset quantity of the data streams displayed on each page; and paging displaying the at least one target data stream according to an allocation result.

9. A non-transitory computer readable storage medium, wherein the computer readable storage medium stores a computer program, and when the computer program is executed by a processor, the processor is caused to implement steps in a vehicle data stream displaying method, comprising: numbering at least one vehicle data stream that is displayed out of order on a display of the vehicle diagnostic device; sorting the at least one vehicle data stream, and displaying the at least one vehicle data stream according to a sorting order; receiving a target data stream selection instruction through the display of the vehicle diagnostic device, and determining at least one target data stream from the at least one vehicle data stream according to the target data stream selection instruction; paging displaying the at least one target data stream by displaying the at least one target stream on one of a plurality of pages of the display; obtaining number data of the target data stream displayed on each page, and establishing a correlation relationship between a displayed page number and the number data;

reading, if a refreshing instruction is received, a display page number of the current page, and then obtaining number data of the target data stream displayed on the current page according to the display page number and the correlation relationship between the display page number and the number data; and requesting to read a corresponding vehicle data stream according to the number data of the target data stream displayed on the current page, and refreshing the target data stream displayed on the current page by using the corresponding read vehicle data stream.

10. The non-transitory computer readable storage medium according to claim 9, wherein the processor is further configured to perform the step of paging refreshing the target data stream displayed on the current page, according to the correlation relationship between the display page number and the number data if the refreshing instruction is received by: reading a displayed page number of the current page if the refreshing instruction is received, and then obtaining number data of the target data stream displayed on the current page according to the display page number and the correlation relationship between the displayed page number and the number data; and requesting to read a corresponding vehicle data stream according to the number data of the target data stream displayed on the current page, and refreshing the target data stream displayed on the current page by using the read vehicle data stream.

11. The non-transitory computer readable storage medium according to claim 9, wherein the processor is further configured to: determine whether the vehicle diagnostic device is currently in a vehicle data stream recording state after the refreshing instruction is received; and perform the step of paging refreshing the target data stream displayed on the current page, according to the correlation relationship between the display page number and the number data if the vehicle diagnostic device is in a non-recording state; or select number data of target data streams displayed on all pages, and perform page refreshing according to the number data of the target data streams displayed on all the pages if the vehicle diagnostic device is in the recording state.

12. The non-transitory computer readable storage medium according to claim 9, wherein the processor is further configured to perform the step of paging displaying the at least one target data stream by: calculating a total quantity of pages according to a total quantity of obtained target data streams and a preset quantity of data streams displayed on each page; allocating the target data stream correspondingly displayed on each page in an ascending order or a descending order of a letter of a data stream title according to the preset quantity of the data streams displayed on each page; and paging displaying the at least one target data stream according to an allocation result.

* * * * *